US005664392A

United States Patent [19]

Mucha

[11] Patent Number: 5,664,392

[45] Date of Patent: Sep. 9, 1997

[54] DEFLECTION CLIP

[76] Inventor: Brian A. Mucha, 3100 Chesley Ave., Baltimore, Md. 21234

[21] Appl. No.: 629,086

[22] Filed: Apr. 8, 1996

[51] Int. Cl.[6] ..... E04B 1/38

[52] U.S. Cl. ..... 52/715; 52/712; 52/285.3; 52/235; 52/655.1; 52/656.9; 248/262

[58] Field of Search ..... 52/712, 715, 702, 52/235, 285.1, 285.3, 655.1, 656.9; 160/902; 248/262

[56] References Cited

U.S. PATENT DOCUMENTS

| | | | |
|---|---|---|---|
| 2,640,533 | 6/1953 | Junkunc | 160/902 X |
| 3,321,880 | 5/1967 | Ferrell et al. | 52/235 |
| 3,972,168 | 8/1976 | Allen | 52/702 X |
| 4,352,433 | 10/1982 | Ford | 248/262 X |
| 4,570,400 | 2/1986 | Slager et al. | 52/235 |
| 5,060,710 | 10/1991 | Haarer | 248/262 X |
| 5,131,616 | 7/1992 | Biba | 160/902 X |

*Primary Examiner*—Robert Canfield
*Attorney, Agent, or Firm*—Larson And Taylor

[57] ABSTRACT

A deflection clip is provided for connection between a non-load bearing stud member of a building and a further, load bearing structure of the building such as a floor or roof frame member. The clip comprises an integral, single piece angle member consisting of first and second substantially planar plate portions located in orthogonal planes and joined together along a common lateral edge. The angle member includes a substantially centrally located, raised stiffener portion disposed intermediate the upper and lower edges thereof. The first plate portion includes a plurality of spaced, vertically extending slots for receiving fasteners used in affixing this first portion to the stud member. The second portion, which is adapted to be connected to the further structure, includes first and second spaced, parallel stiffener portions extending outwardly from the corresponding upper and lower edges of the angle member, orthogonally to the plane of the second portion.

16 Claims, 3 Drawing Sheets

DEFLECTION CLIP

BACKGROUND OF THE INVENTION

1. Field of the Invention

The present invention relates to slide or deflection clips for connecting non-load bearing studs to further structures of a building construction.

2. The Prior Art

By way of background, many building constructions use a load bearing skeletal framework and non-load bearing curtain walls. The latter are formed by vertical studs and are connected to the framework. The framework typically comprises a plurality of spaced vertical columns which support horizontal beams that support the floors and roof of the building. The loads applied to the floors and roofs often vary and as a consequence, the beams undergo substantial vertical deflections. The floors and roof are adapted to withstand these deflections but the curtain walls must be isolated from these deflections in order to prevent damage to the curtain walls.

A number of different clips and the like have been designed to connect the studs of the curtain wall to the building structure, i.e., the ceiling/floor and roof. For example, one prior art deflection clip, made by Super Stud Building Products, Inc. of Astoria, N.Y., comprises the combination of a bent angle member with a pair of spaced deformed stiffeners, and a backer plate. The latter is secured to one part of the angle member through a slotted hole by the combination of large and small head rivets and spring washer. In use, the other part of the angle member is secured to the building structure (e.g., to a steel angle thereof) and the backer plate is secured to a curtain wall stud. The clip is said to provide lateral support for the framing member (the stud) while allowing vertical deflection of the primary frame. Other slide clips and deflection clips of background interest are made by Detrich, Dale, and Unimast Incorporated.

Patents of possible interest in this field and related fields include the following: U.S. Pat. Nos. 4,570,400 (Slager et al.); 3,798,865 (Curtis); 5,040,345 (Gilmour); 5,216,858 (Gilmour); and 4,831,808 (Wynar). The Slager et al. patent discloses a slide clip for connecting a curtain wall stud to a load bearing framework of a building wherein detents enable the clip to be pushed onto the stud. The Curtis patent discloses a twist-cam clip for securing together longitudinal and cross members of ceiling structure. The slide slides along a track mounted on the longitudinal members. The Gilmour '345 patent discloses a stud clip which permits vertical floating of a horizontal member. The Gilmour '858 patent discloses a U-shaped vertical movement clip used in connecting a non-load bearing exterior curtain wall to a building framework. The Wynar patent discloses a self-adjusting wallboard clip used in drywall constructions.

SUMMARY OF THE INVENTION

In accordance with the invention, a deflection clip is provided which affords a number of important advantages. The clip permits a stud to be attached to the slab edge of a building structure (e.g., a floor or roof structure) without the stud being a tight fit against the structure. This accommodates inherent construction tolerances as well as allows for mistakes in construction which result in different spacings between the stud and the building structure. The clip can be installed using commonly available screws and/or other fastening devices and techniques, and no special equipment is required to install the clip. The single piece, unitary construction of the clip provides obvious advantages over the prior art multiple piece clip described above, both with respect to manufacture and handling in use.

In accordance with a preferred embodiment deflection clip is provided for connection between a non-load bearing stud member of a building and a further, load bearing structure of the building, the clip comprising: an integral, single piece angle member comprising first and second substantially planar plate portions located in orthogonal planes and joined together along a common lateral edge, each of the first and second portions including a further lateral edge opposed to the common lateral edge; the angle member including a substantially centrally located, raised stiffener portion disposed intermediate to the upper and lower edges thereof; the first portion of the angle member including at least two spaced, vertically extending slots for receiving fasteners used in affixing said first portion to the stud member, and the second portion further including first and second spaced, parallel stiffener portions extending outwardly from the corresponding upper and lower edges of the angle member, orthogonally to the plane of the second portion. The raised stiffener adds strength and stiffness to the clip and increases the load carrying capacity thereof, while the parallel "return" stiffeners of the second portion substantially increase the tension load carrying capacity of the clip.

Preferably, the vertically extending slots are arranged in two vertically spaced groups each comprising at least two, and, advantageously, three, lateral spaced slots. In an advantageous embodiment, the slots of one of the two groups are laterally offset from the slots of the other of said two groups.

The second portion preferably includes a plurality of fastener holes for receiving fasteners used in affixing the second portion to the further structure. In an advantageous embodiment, the plurality of fastener holes comprises two pairs of holes, and the pairs of holes are disposed on opposite sides of the central stiffener portion.

Other features and advantages of the invention will be set forth in, or apparent from, the following detailed description of the preferred embodiment of the invention.

DESCRIPTION OF THE PREFERRED EMBODIMENTS

Figure 2:
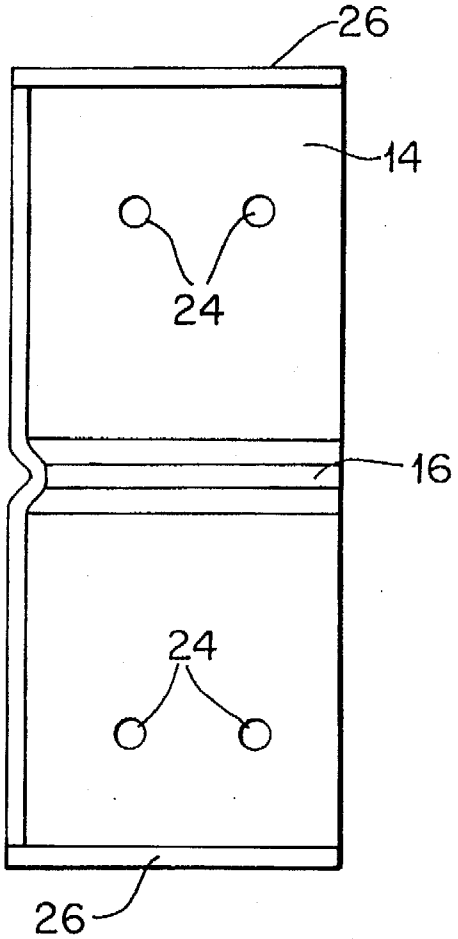
FIGS. 2 and 3 are opposite end views of the clip of FIG. 1.
Figure 1:
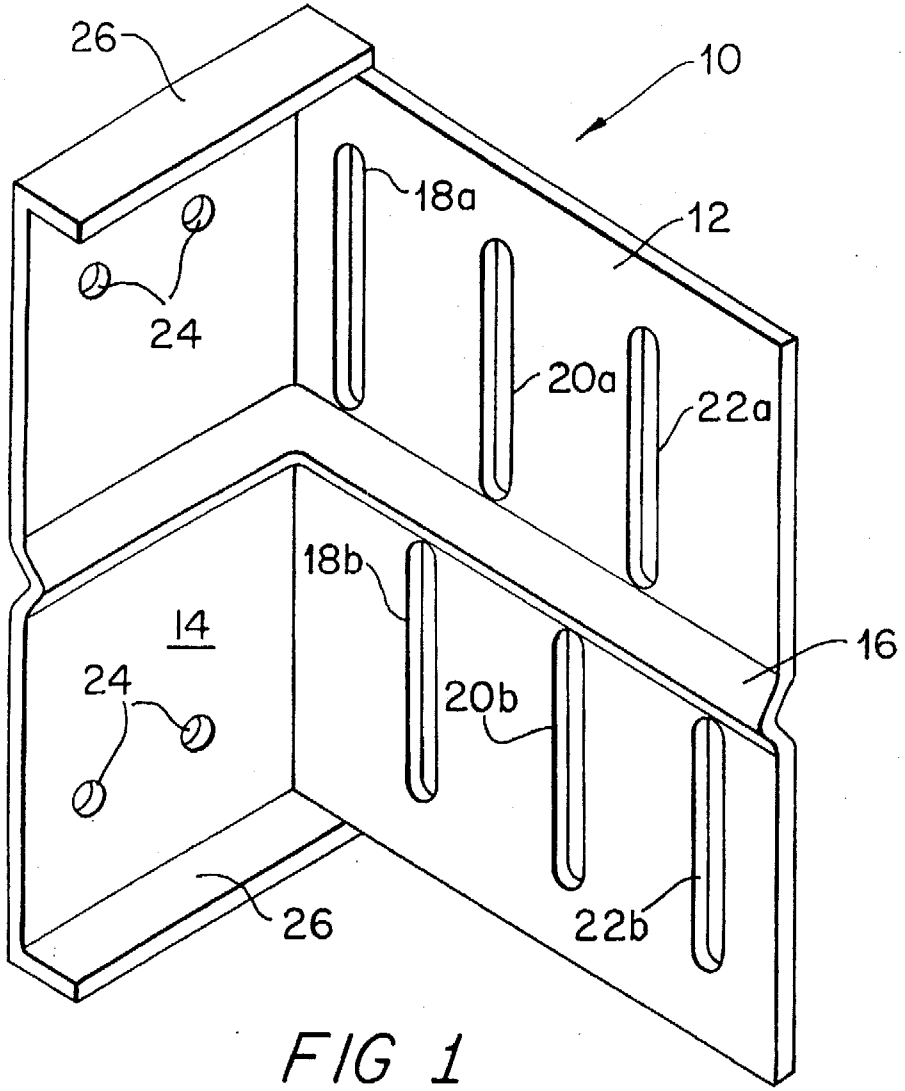
FIG. 1 is a perspective view of a deflection clip constructed in accordance with a preferred embodiment of the invention.
Figure 3:
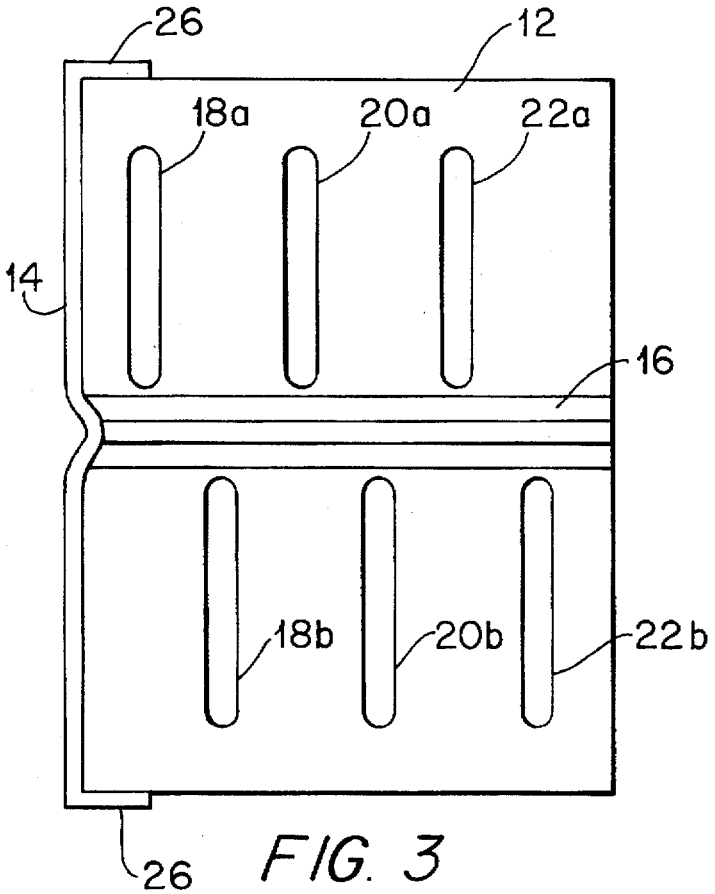

Referring particularly to FIGS. 1 to 4, there is shown a deflection clip, generally denoted 10, constructed in accordance with a preferred embodiment of the invention. The clip 10 is a single piece integral unit including first and second substantially planar, plate portions 12 and 14 which lie in orthogonal planes. A central reinforcing element or raised stiffener 16 is located centrally of clip 10 between the upper and lower edges thereof as viewed in FIG. 1, and, as illustrated, basically extends between the opposite, free edges of clip 10. Stiffener 16 adds important strength and load carrying capacity to clip 10 and the central location provides advantageous, economical use of the space, or surface area, presented by the clip.

The first plate portion 12 includes three pairs of vertical slots 18*a*, 18*b*, 20*a*, 20*b* and 22*a*, 22*b*, with the slots of each pair being located on opposite sides of stiffener 16 as shown. These slots are adapted to receive screws or like fasteners used to screw the clip 10 to a stud, and two screws, i.e., one in the upper slot and one in the lower slot, are required to load the clip 10 in a uniform manner. The vertical slots themselves accommodate up and down movement of the structure to which the second plate portion 14 is affixed, as mentioned above and is explained in more detail below in connection with FIG. 6. Further, the lateral spacing of the pairs of slots 18*a*, 18*b*, 20*a*, 20*b* and 22*a*, 22*b* enables out of plumb ceiling/floor and roof structures, i.e., ceiling/floor and roof structures which are spaced different distances from the stud, to be accommodated, as was also mentioned above and is also discussed in more detail below in connection with FIG. 6.

Second plate 14 includes a plurality of holes 24 therein which are positioned in pairs above and below central stiffener 16 as shown. A pair of further "return" stiffeners 26 are formed from, i.e., bent out of, upper and lower portions of the second plate or plate portion 14 so as to extend outwardly from the plane thereof and to form a right angle therewith. These orthogonal edge stiffeners 26 extend a short distance along the respective edge of first plate portion 12 parallel to that edge. This additional reinforcement or strengthening is required because movement of the ceiling-floor structure will stress the clip and, in particular, stress the second plate portion 14 such that steel tends to bend about the screws. The edge stiffeners 26, together with central stiffener 16, combat this and significantly reduce clip failure.

Figure 5:
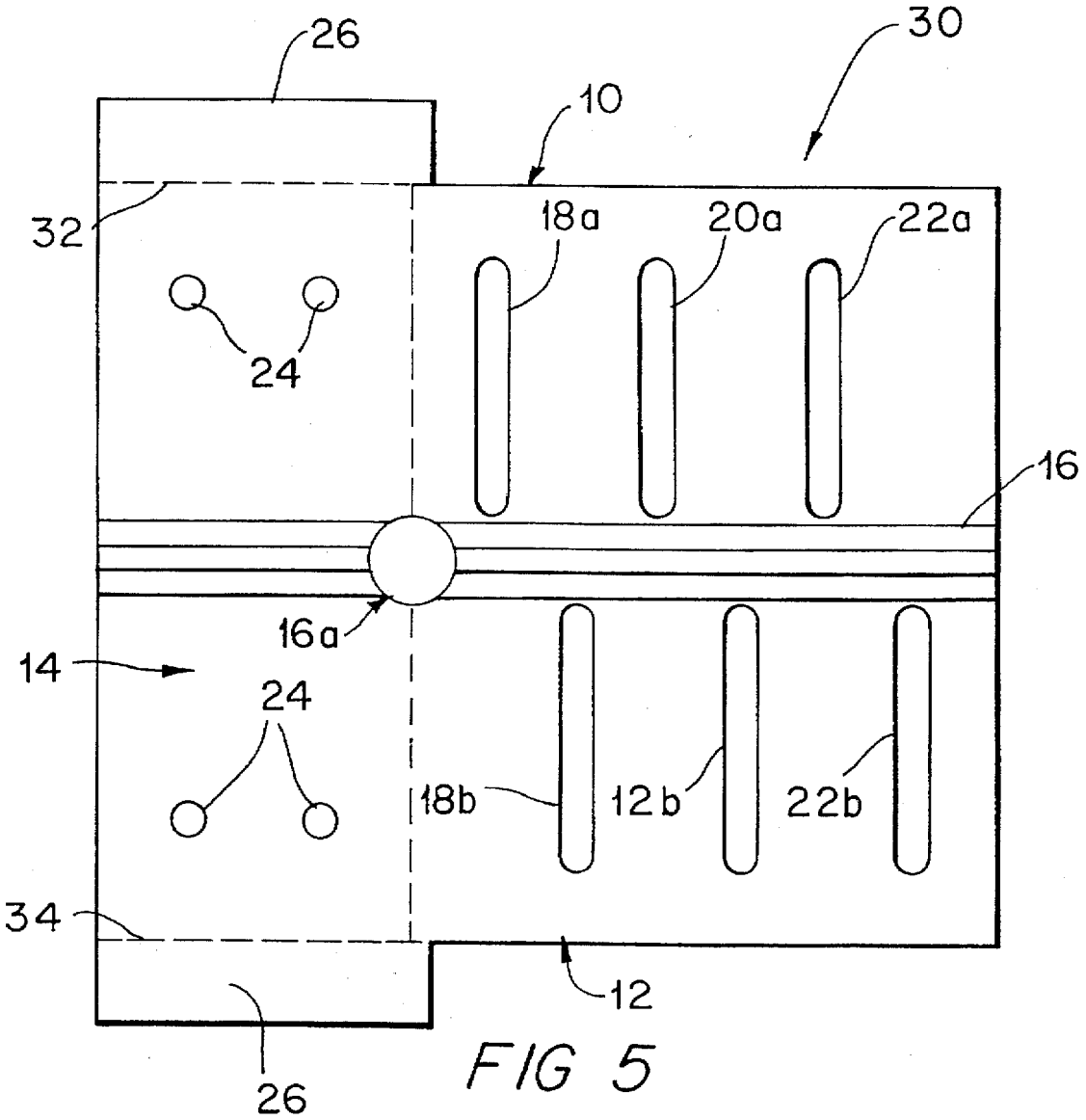
FIG. 5 is a top plan view of a blank from which the clip of FIG. 1 is made.

Referring to FIG. 5, a blank used in making the clip is used. The blank, which is generally denoted 30, is a planar element and corresponding portions of the finished clip illustrated in FIGS. 1 to 4 are indicated by the same reference numerals in FIG. 5. Folding or bending lines in blank 30 are indicated at 32 and 34. It will be appreciated that the clip 10 of FIGS. 1 to 4 is produced from blank 30 in a very simple manner, i.e., by bending or folding the blank 30 along fold line 32 to produce or create the orthogonal relation between plate portions 12 and 14, and by bending or folding each of the edge stiffeners 26 along a respective fold line 34 to an orthogonal plane to produce the configuration discussed above. A hole 16*a* in central stiffener 16 (not shown in FIGS. 1 to 4) readily enables bending or folding of the stiffener.

Although the present invention is obviously not limited to such a specific implementation, in a particular exemplary embodiment, plate portion 12 is 3½ inches long, and 4⁵⁄₁₆ inches wide, plate portion 14 is 2 inches long by 4½ inches wide, stiffener plates 26 are 2 inches by ½ inch and stiffener 16 is ½ inch wide. Slots 18*a*, 20*a* and 22*a*, which are 1½ inches long, are 1 inch apart, with slot 18*a* being spaced ½ inch from the common edge, and slots 18*b*, 20*b* and 22*b*, which are also 1½ inches long, are also 1 inch apart, with slot 22*b* being spaced ½ inch from the free edge. The slots are each spaced ¹³⁄₃₂ inch from the upper (or lower) edge. The pairs of holes 24 are ¾ inch apart and are spaced from the free and common edges by ½ inch and ¾ inch, respectively, and from the top (or bottom) edge by ¾ inch.

Figure 6:
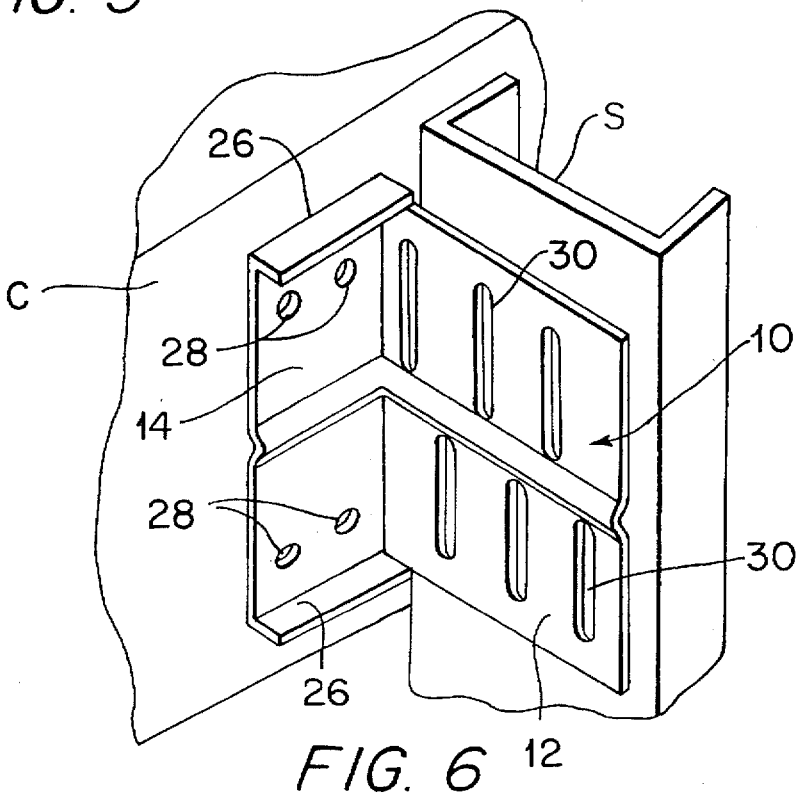
FIG. 6 is a perspective view showing the clip of FIG. 1 in use in interconnecting a building structure, such as a ceiling/floor structure, and a stud.
Figure 4:
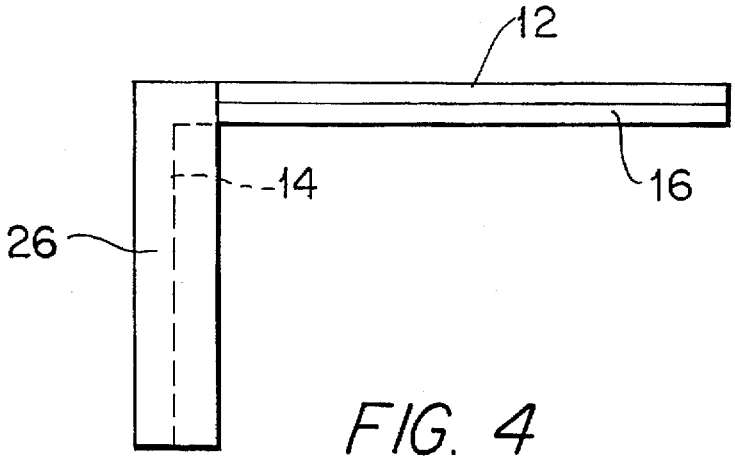
FIG. 4 is a top plan view of the clip of FIG. 1 (the bottom plan view being a mirror image)

Referring to FIG. 6, the deflection clip 10 is shown as installed between a ceiling/floor structure indicated schematically at C and an upright metal stud S. As discussed above, a very solid, positive attachment is made to ceiling/floor structure C so that the clip 10 will move with the structure. Suitable fasteners such as screws 28 are used for this purpose although welds, nails, gripping fingers and the like can also be used. It will be appreciated that the showing in FIG. 6 is schematic in nature and that, for example, the surface to which the second plate portion 14 is secured can be that of an angle iron (not shown) forming the slab or lateral edge of the ceiling/floor structure C. As mentioned above and as will be understood by those skilled in the art, stud S is not a load bearing element, and ceiling/floor structure C will be supported by load bearing elements. However, as stated above, the ceiling/floor structure C will still undergo up and down movement despite this support, and the vertical adjustability provided by vertical slots in the first plate portion 12 will accommodate such movement. Moreover, as was also mentioned above, the inherent adjustability provided by the clip 10 will also allow for variation in building tolerances with respect to the spacing between the stud S and the slab edge of the ceiling/floor structure C.

Although the present invention has been described to specific exemplary embodiments thereof, it will be understood by those skilled in the art that variations and modifications can be effected in these exemplary embodiments without departing from the scope and spirit of the invention.

What is claimed is:

1. A deflection clip for connection between a non-load bearing member of a building and a further, load bearing structure of the building, said clip comprising:

an integral, single piece angle member comprising first and second substantially planar plate portions located in orthogonal planes and joined together along a common lateral edge, each of said first and second portions including a further lateral edge opposed to said common lateral edge;

said member having upper and lower edges and including a substantially centrally located, raised stiffener portion disposed intermediate said upper and lower edges;

said first portion including at least two spaced, vertically extending slots for receiving fasteners used in affixing said first portion to the non-load bearing building member, and said second portion including first and second spaced stiffener portions extending outwardly from the corresponding upper and lower edges of said member and including means for enabling the fastening of said second portion to said load bearing building member wherein said vertically extending slots are arranged in two vertically spaced groups each comprising at least two lateral spaced slots.

2. A deflection clip as claimed in claim 1, wherein said slots of one of said two groups are laterally offset from the slots of the other of said two groups.

3. A deflection clip as claimed in claim 1, said second portion includes a plurality of fastener holes for receiving fasteners used in affixing said second portion to the further structure.

4. A deflection clip as claimed in claim 3, wherein said plurality of fastener holes comprises two pairs of holes, and said pairs of holes are disposed on opposite sides of said central stiffener portion.

5. A deflection clip as claimed in claim 1, wherein said vertically extending slots are arranged in two vertically spaced groups disposed on opposite sides of said central stiffener portion and each of said groups comprises three laterally spaced slots.

6. A deflection clip as claimed in claim 5, wherein said slots of said two groups are laterally offset from one another.

7. A deflection clip as claimed in claim 5, said second portion includes a plurality of fastener holes for receiving fasteners used in affixing said second portion to the further structure.

8. A deflection clip as claimed in claim 7, wherein said plurality of fastener holes comprises two pairs of holes, and said pairs of holes are disposed on opposite sides of said central stiffener portion.

9. A deflection clip as claimed in claim 1, wherein said stiffener portions are plates which extend outwardly orthogonally to the plane of said second portion.

10. A deflection clip as claimed in claim 9, wherein said first and second plate stiffener portions respectively overlap and contact said upper and lower edges of said first main portion; and wherein said enabling means comprise circular fastener holes for receiving fasteners used in affixing said second portion to said load bearing building member, at least one hole being disposed on each side of said stiffener portion.

11. A deflection clip for connection between a stud member of a building and a further structure of the building, said clip comprising: an integral, single piece angle member comprising first and second substantially planar plate portions located in orthogonal planes and joined together along a common lateral edge, each of said first and second portions including a further lateral edge opposed to said common lateral edge; said member having upper and lower edges and including a substantially centrally located, raised stiffener portion disposed intermediate said upper and lower edges and extending from the further lateral edge of said first portion to said common edge and from said common edge to the further lateral edge of said second portion; said first portion including at least two spaced, vertically extending slots for receiving fasteners used in affixing said first portion to the stud member, and said second portion including a plurality of fastener holes therein for receiving fasteners used in affixing said second portion to the structure, said second portion further comprising first and second spaced, parallel stiffener portions extending outwardly from the corresponding upper and lower edges of said member, orthogonally to the plane of said second portion wherein said vertically extending slots are arranged in two vertically spaced groups each comprising at least two lateral spaced slots.

12. A deflection clip as claimed in claim 10, wherein said slots of one of said two groups are laterally offset from the slots of the other of said two groups.

13. A deflection clip as claimed in claim 11, wherein said plurality of fastener holes comprise two pairs of holes, and said pairs of holes are disposed on opposite sides of said central stiffener portion.

14. A deflection clip as claimed in claim 11, wherein said vertically extending slots are arranged in two vertically spaced groups disposed on opposite sides of said central stiffener portion and each of said groups comprises three laterally spaced slots.

15. A deflection clip as claimed in claim 14, wherein the three slots of said two groups are laterally offset from one another.

16. A deflection clip as claimed in claim 15, wherein said plurality of fastener holes comprise two pairs of holes, and said pairs of holes are disposed on opposite sides of said central stiffener portion.

* * * * *